US008727435B2

(12) United States Patent
Centracco et al.

(10) Patent No.: US 8,727,435 B2
(45) Date of Patent: May 20, 2014

(54) TRAY APPARATUS AND METHODS OF MAKING AND USING SAME

(76) Inventors: Zahia Centracco, Oklahoma City, OK (US); Danielle Batchelor, Houston, TX (US)

( * ) Notice: Subject to any disclaimer, the term of this patent is extended or adjusted under 35 U.S.C. 154(b) by 273 days.

(21) Appl. No.: 12/732,953

(22) Filed: Mar. 26, 2010

(65) Prior Publication Data

US 2010/0176626 A1 Jul. 15, 2010

Related U.S. Application Data

(63) Continuation-in-part of application No. 12/171,369, filed on Jul. 11, 2008, now Pat. No. 7,717,504.

(60) Provisional application No. 60/959,408, filed on Jul. 13, 2007.

(51) Int. Cl.
*A41D 13/04* (2006.01)

(52) U.S. Cl.
USPC ..... 297/182; 2/49.3

(58) Field of Classification Search
USPC ..... 297/136, 182, 219.1, 219.12; 2/49.1–49.3
See application file for complete search history.

(56) References Cited

U.S. PATENT DOCUMENTS

| | | | | | |
|---|---|---|---|---|---|
| 284,671 | A * | 9/1883 | Reed | 2/49.5 |
| 1,261,575 | A * | 4/1918 | McLeod | 2/50 |
| 2,594,053 | A * | 4/1952 | McKewen | 2/49.5 |
| 2,672,614 | A * | 3/1954 | Zimmerman et al. | 2/49.3 |
| 2,700,413 | A * | 1/1955 | Williams | 297/182 |
| 2,767,403 | A * | 10/1956 | Givens | 2/49.4 |
| 2,905,943 | A * | 9/1959 | Carlisle et al. | 2/49.5 |
| 3,597,763 | A * | 8/1971 | Bienvenu | 2/49.3 |
| D338,319 | S * | 8/1993 | Bickel | D2/864 |
| 5,671,479 | A * | 9/1997 | Dedrick | 2/46 |
| 6,532,595 | B1 * | 3/2003 | Holmes | 2/48 |
| 6,708,341 | B1 * | 3/2004 | Schaller | 2/51 |

* cited by examiner

*Primary Examiner* — Peter Brown
(74) *Attorney, Agent, or Firm* — Hall Estill Law Firm

(57) ABSTRACT

A tray apparatus includes a bib portion and a tray portion. The bib portion is sized and dimensioned to be positioned about an individual. The tray portion substantially surrounding the bib portion so as to provide a surface for providing a sanitary barrier. The tray apparatus further includes a loop member connected to the tray portion for keeping the tray portion taut or for collapsing the tray apparatus.

9 Claims, 7 Drawing Sheets

TRAY APPARATUS AND METHODS OF MAKING AND USING SAME

CROSS-REFERENCE TO RELATED APPLICATION

The present application is a continuation-in-part of U.S. patent application Ser. No. 12/171,369, filed Jul. 11, 2008, now U.S. Pat. No. 7,717,504, entitled "CHILD SEAT APPARATUS" which claims priority to U.S. Ser. No. 60/959,408, filed on Jul. 13, 2007, the entire contents of all which are hereby incorporated by reference in their entirety.

TECHNICAL FIELD

The present invention relates generally to a child seat apparatus, and more particularly, but not by way of limitation, to an improved child seat apparatus for preventing food and objects from falling to the floor. Further, the present invention relates generally to a tray apparatus, and more particularly, but not by way of limitation, to a tray apparatus for preventing food and objects from falling to the floor and for providing a sanitary barrier between the individual and any surface.

BACKGROUND OF THE INVENTION

A family with small children, such as babies or toddlers, who go to a restaurant or other such facility for dining often utilize a standard restaurant high chair or child seat. Typically, the standard restaurant high chair or child seat is made from wood, plastic or other such material and only includes a place for the child to sit. The high chair provides restraints, such as a belt, to be placed around the waist of the child placed therein. The child is strapped in the high chair, and the high chair is typically positioned in proximity to the table so that the child utilizes a table surface for eating or performing other activities, such as playing with a toy, coloring, etc.

Typically, small children tend to throw or drop food, toys, or other such objects on the floor or ground while sitting at the table in a restaurant, home, cafeteria, and the like, or in a car seat, stroller seat, booster seat, Bumbo style baby seat, and the like, for example. The dropping of toys or food can disrupt a table conversation, creates noise and distraction, requires the parent or care giver to repeatedly pick the dropped toys off the floor causing frustration to both child and parent and also precludes re-use of the toy or food because of contact with the floor.

In addition, high chairs, other chairs, seats, or table surfaces are normally not very clean having been dirtied by other children or other individuals when dining at a restaurant or some other area for eating, such as a cafeteria, assisted living room, or the like. Typically, a child places their hands or mouth on the high chair or table surfaces, thus placing the child or individual in contact with bacteria and other various disease-causing germs that may lead to illness. Further, individuals having health issues or needing assistance may come in contact with eating surfaces having unsanitary conditions.

To this end, although child seat covers of the existing art are operable, further improvements are desirable to enhance the use of a child seat apparatus which functions to prevent food, toys and other objects from falling to the floor, prevent child contact with the high chair and table surfaces to act as a sanitary barrier and extend the reachable eating or playing surface for the child or individual. It is to such a child seat apparatus that at least one embodiment of the present invention is directed. Further, improvements are desirable to provide a sanitary barrier to eating and activity surfaces for all individuals. It is to such a tray apparatus that at least one embodiment of the present invention is directed.

BRIEF SUMMARY OF THE INVENTION

To overcome shortcomings of the known art, at least one embodiment of the present invention is directed to a child seat apparatus formed with (i) a seat portion that is sized and dimensioned to receive a child, and (ii) a tray portion adapted to provide a utility surface adjacent to the child for retaining objects within the child's reach and/or preventing the child from direct contact with a seat or table surface.

To overcome shortcomings of the known art, at least one embodiment of the present invention is directed to a tray apparatus formed with (i) a bib portion that is sized and dimensioned to be positioned about an individual, and (ii) a tray portion adapted to provide a utility surface adjacent to an individual for retaining objects within the individual's reach and/or preventing the individual from direct contact with a seat or table surface, and preventing food and objects from falling to the floor.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE OF THE INVENTION

Figure 1:
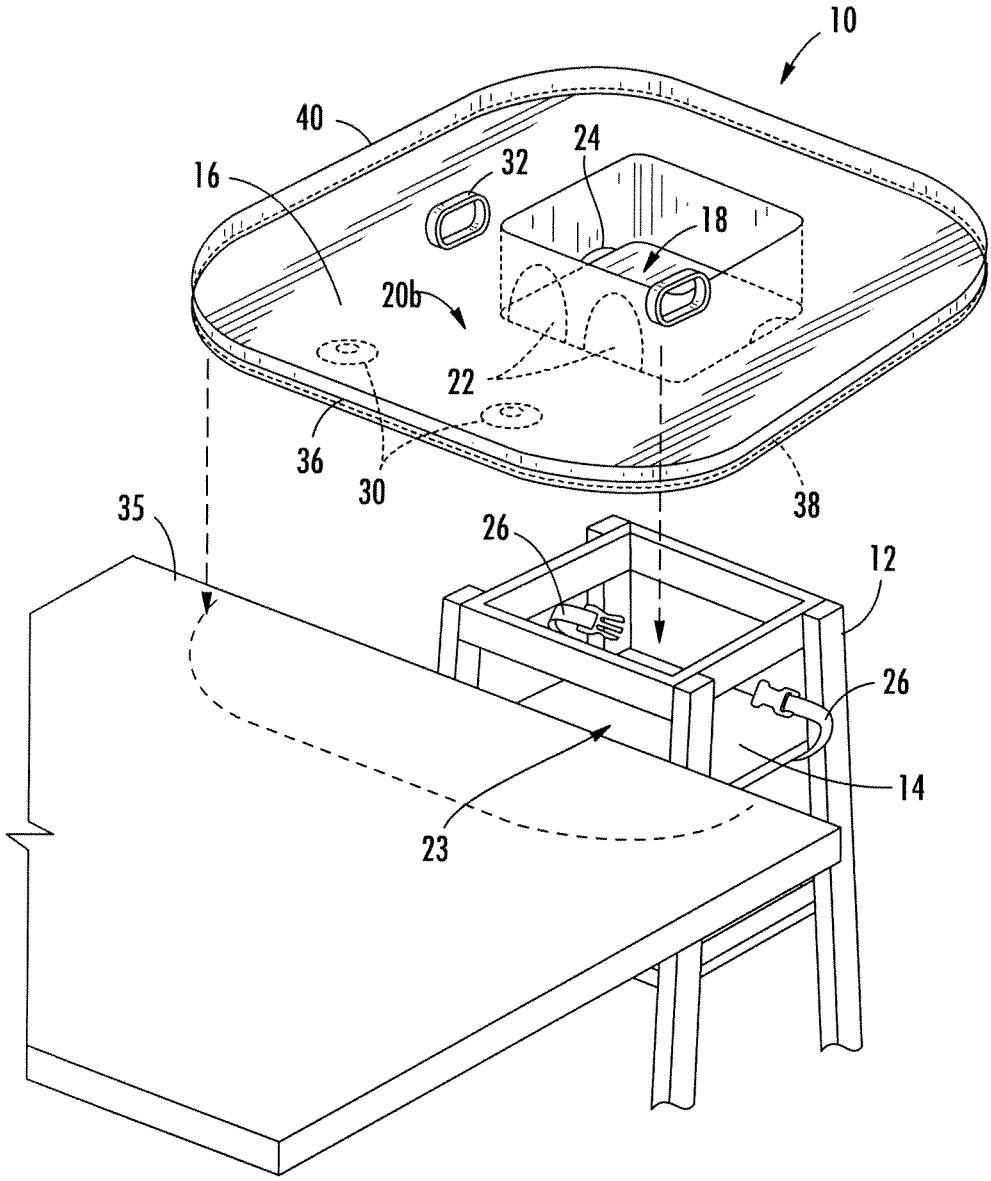
FIG. 1 is a perspective view of a child seat apparatus constructed in accordance with the present invention, the child seat apparatus being disposed on a high chair.

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. It is also understood that, for purposes of clarity, like reference numerals identify like structures in each of the figures.

Referring now to the drawings, shown therein is a child seat apparatus 10 constructed in accordance with embodiments of the present invention, the child seat apparatus 10 being shown disposed on a high chair 12 (FIG. 1). The high chair 12 has a seat 14, shown in FIG. 1, and is a conventional high chair utilized in most restaurants and known to one of ordinary skill in the art. Thus, no further description of the high chair 12 is believed necessary for one of ordinary skill in the art to understand and practice embodiments of the present invention. However, it should be understood that any variety of high chairs may be utilized with the child seat apparatus 10 as long as the child seat apparatus 10 functions in accordance with embodiments of the present invention. Further, it should be understood that the child seat apparatus 10 may be adapted to be utilized with any other type of child seat, including but not limited to a car seat, stroller seat, booster seat, Bumbo style baby seat, and the like, for example.

The child seat apparatus 10 may be constructed from a light-weight foldable material to enhance portability. Suitable materials for construction include woven, non-woven fabric, flexible plastic film materials such as vinyl, plastics, polymeric materials, and composite materials. The material may be water-resistant or waterproof so that the child seat apparatus 10 may be easily cleaned and/or disinfected after use. However, the child seat apparatus 10 may be constructed from any washable material as well. In addition, the child seat apparatus 10 may be constructed from any disposable material, such as a disposable waxed or coated flexible paper or thin plastic. The child seat apparatus 10 may also be constructed in any of a variety of colors and patterns. The child seat apparatus 10 material may also be formed of a mesh or net-like material, designed to catch solid objects but allow fluids to pass. Further, it will be appreciated that the child seat apparatus 10 can be sized and shaped from any suitable material, that (completely or partially) surrounds the child in a manner that prevents objects from escaping the child's reach, prevents child contact with other surface areas, extends the child's playing surface, and/or otherwise functions as described herein. It should be understood by one of ordinary skill in the art that the child seat apparatus, although discussed herein being used with a child, may be utilized and configured in a variety of capacities for individuals of different ages, such as teenagers, adults, senior adults, or those in need of assistance, and the like.

In one embodiment, the child seat apparatus 10 includes a body 16 having a seat portion 18 and a tray portion 20. The seat portion 18 is sized and dimensioned to fit the seat 14 of the high chair 12, or other suitable seat types. The seat portion 18 may be formed of a selectively expandable material adapted to receive the lower body portion or torso of a child. The seat portion 18 is provided with apertures 22 for allowing legs of a child to be positioned there-through. The apertures 22 are positioned in the seat portion 18 and oriented with the leg opening(s) 23 of the high chair 12, as necessary, to receive the legs of the child. The seat portion 18 is also provided with apertures 24 for passage of straps 26 that form a high chair belt. Passage of the straps 26 through the apertures 24 allows the straps 26 to be positioned around the child's waist and fastened, if desired. Belt fasteners are generally known in the art and may include clips, snaps, hook and loop, buckles, and the like, so that the child is secured in the seat portion 18 of the child seat apparatus 10 and to the high chair 12.

As shown in FIGS. 1-4, the tray portion 20 substantially surrounds the seat portion 18 of the child seat apparatus 10 so as to provide a utility, play and/or eating surface or tray to prevent food, toys, pacifiers, etc., from falling to the floor during restaurant visits. The surface of the tray portion 20 prevents child contact with high chair or table surface areas acting as a sanitary barrier, and may be sanitized with cleaning agents as desired. It should be understood that the tray portion 20 may partially or completely surround the seat portion 18. In alternative embodiments, however, the tray portion 20 surrounds only a portion of the seat portion 18. The tray portion 20 may be permanently or removably connected to the seat portion 18. The tray portion 20 is shown as substantially circular in shape, however, it should be understood that the tray portion 20 may be any shape, such as oval, square, rectangular, triangular, polygonal, quadrilateral, ellipsoidal and the like, for example. Top side restraint straps 32 may be attached to the front and sides of the tray portion 20 for holding toys or other objects within reach of the child to teethe on or play with during restaurant visits. Under side restraint straps (not shown) are optionally attached on the underside of the tray portion 20 or seat portion 18 to secure the child seat apparatus 10 to a child seat or other structure. Fasteners, such as suction cups 30 are optionally attached to the underside of the tray portion 20 for securing the tray portion 20 to a table 35 or other structure.

The child seat apparatus 10 includes a loop member 38 or support member attached to the tray portion 20 at a position near the outer perimeter of the tray portion 20. However, it should be understood that the loop member 38 may be positioned anywhere on the tray potion 20, so long as the loop member 38 functions as described herein. The loop member 38 keeps the tray portion 20 taut when the child seat apparatus 10 is in an extended position. The loop member 38 may be constructed or formed of any light weight, flexible, foldable or resilient material, such as steel wire, plastic, nylon, etc., that is sized and dimensioned such that the loop member 38 tends to return to such dimension after flexing or bending. The loop member 38 may also be formed of a malleable or impressionable material, such as copper wire, metal alloy or injection molded material that may be shaped and reshaped to achieve a desired dimension, which is useful when the child seat apparatus 10 is set up to rest upon support structures of different heights and sizes. The loop member 38 is flexed to collapse the child seat apparatus 10 into a smaller circular form for storage in a bag or simply for easier movement from one location to another when the child seat apparatus 10 is in a collapsed position (See FIGS. 5-6). However, it should be understood by one of ordinary skill in the art that the child seat apparatus may be collapsed into any variety of shapes, such as oval, square, rectangular, triangular, polygonal, quadrilateral, ellipsoidal and the like, depending on the shape of the tray portion 20 and the loop member 38 which may form the shape of the tray portion 20. The loop member 38 may be covered with a piece of material to attach it to the body 16, or disposed in a protective channel integrated with a rim 36 extending circumferentially around the tray portion 20, so as to enable the folding features of the child seat apparatus 10. The protective channel may also prevent contact by a child or other individual with the loop member 38 (See FIG. 2). The loop member 38 may also be removable from the child seat apparatus 10. In an alternative embodiment, the loop member 38 is rigid so that the body 16 tends to retain a single shape. It should be understood that the shape of the collapsible child seat apparatus 10 may vary depending on the shape of the tray portion 20 of the child seat apparatus 10.

In another embodiment, a border 40 extends in a generally vertical direction a distance from the rim 36 so as to contain food, toys, pacifiers, or other objects that are thrown, dropped or might otherwise be dropped on the floor. The ability to contain food provides benefit to the public health by preventing excessive food scrap under high chars, which when quickly cleaned by staff, often leaves residue and crumbs which attract insects and vermin. The border 40 may be constructed out of the same or different material than that used to construct the tray portion 20. The border 40 may be permanently or removably connected to the tray portion 20.

Figure 3:
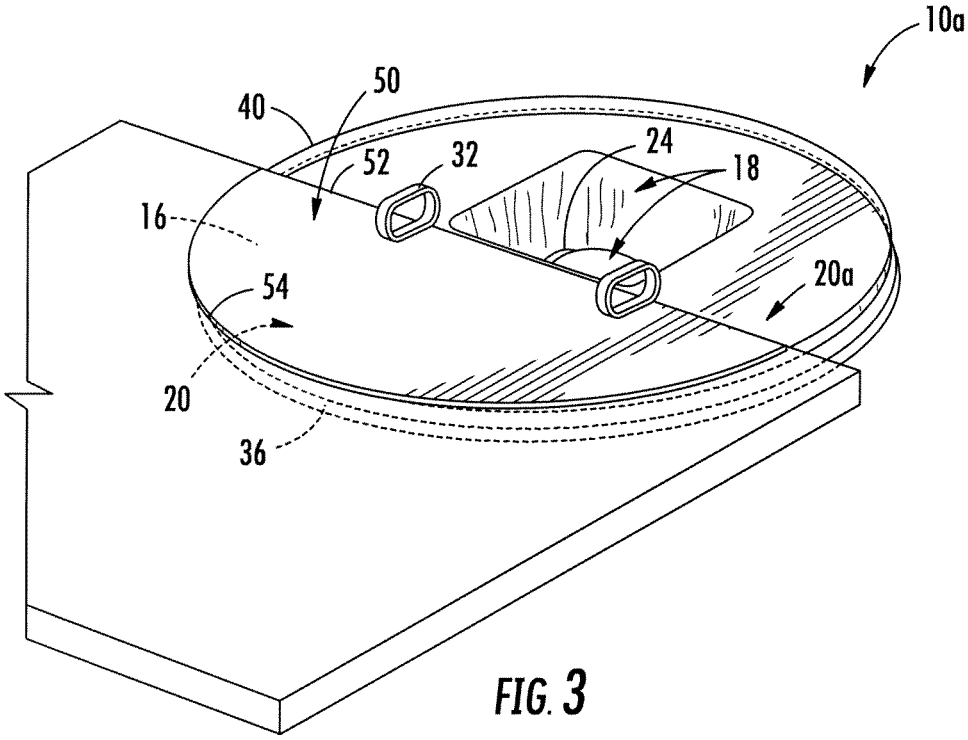
FIG. 3 is a perspective view of another embodiment of a child seat apparatus constructed in accordance with the present invention.

Referring to FIG. 3, an alternative embodiment is shown of a child seat apparatus 10*a* substantially similar to the child seat apparatus 10 except as described herein. The child seat apparatus 10*a* includes a first tray portion 20*a* and a second tray portion 50. The second tray portion 50 is a flap having a first end 52 and a second end 54. The second end 54 of the second tray portion 50 is selectively attachable to the first tray portion 20*a* of the child seat apparatus 10*a*, or alternatively, to the seat portion 18 of the child seat apparatus 10*a* and extends out in a direction away from the seat portion 18 of the child seat apparatus 10*a*. The first end 52 of the second tray portion 50 is selectively attachable to the table 35 by any suitable fastener known to one of ordinary skill in the art. The first tray portion 20*a* of the child seat apparatus 10*a* is selectively attachable under the table 35 by any suitable fastener known to one of ordinary skill in the art. Fasteners, such as suction cups, may be attached to a front portion of the first tray portion 20*a* or of the second tray portion 50 of the child seat apparatus 10*a* for securing the first tray portion 20*a* or the second tray portion 50 of the child seat apparatus 10 to the table 35.

Figure 4:
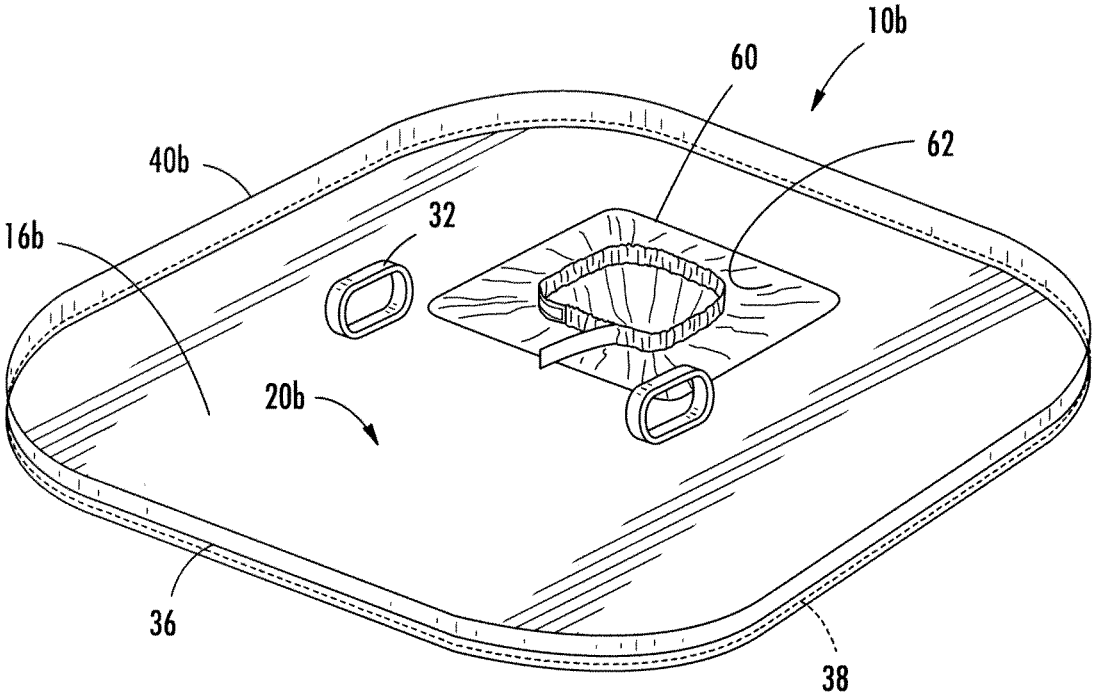
FIG. 4 is a perspective view of another embodiment of a child seat apparatus constructed in accordance with the present invention.

Referring now to FIG. 4, another embodiment is shown of a child seat apparatus 10*b* constructed in accordance with the present invention. The child seat apparatus 10*b* includes a body 16*b* and a tray portion 20*b*. The tray portion 20*b* is provided with an opening 60 that is sized and dimensioned to receive a lower body portion or a torso of a child. The opening 60 is provided with an edge 62 and may be constructed from an elastic or gathered material so that the child seat apparatus 10*b* may be positioned or fitted about the lower body portion or torso of the child. The edge 62 may also be sized and resized for a close fit to the child's body to seal out food, toys, other objects or debris. The tray portion 20*b* surrounds at least a portion of the opening 60 so as to provide a surface for preventing an object from falling to the ground. Optionally, a seat portion 18*b* may be connected to the edge 62. The seat portion 18*b* may be formed of an elastic, gathered, or selectively expandable material that is adapted to size and resize according to the size and shape of a child. In addition, it should be understood by one of ordinary skill in the art that any means for securing one object to another known in the art, such as a belt, may be utilized with the child seat apparatus 10*b* for securing a child to the child seat apparatus 10*b* and child seat. It will be appreciated that the structures of FIG. 4 are substantially similar or the same as structures identified by like reference numerals described elsewhere herein.

Figure 5:
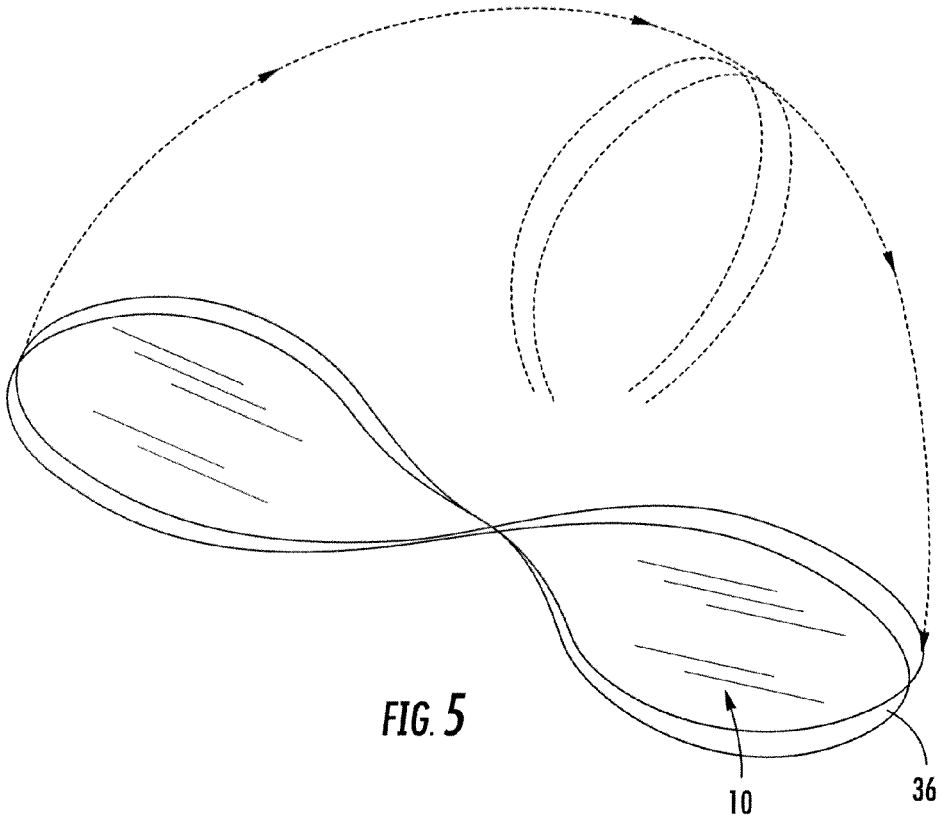
FIG. 5 is a pictorial representation of an embodiment of the child seat apparatus moved between an expanded position and a collapsed position.
Figure 6:
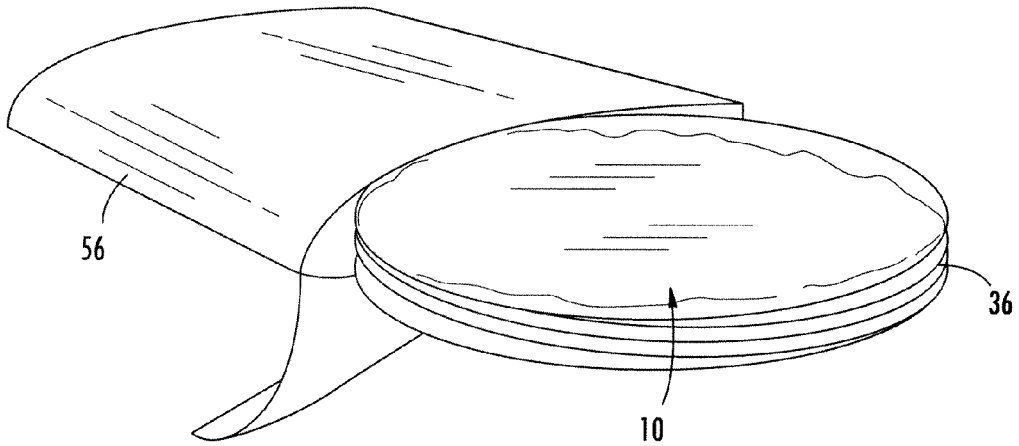
FIG. 6 is a perspective view of an embodiment of the child seat apparatus in the collapsed position being disposed in a bag.

Referring to FIGS. 5 and 6, in the collapsed position, the child seat apparatus 10 is twisted and folded to collapse the loop member 38 into a smaller diameter form. The seat portion 18 collapses with the tray portion 20 and a bag 56, or other such portable carrying device, may be used to hold the collapsed child seat apparatus 10 in the collapsed position. The bag 56 may be constructed from the same material as the child seat apparatus 10. Alternatively, the bag 56 may be constructed from a mesh-like material such as, for example, the mesh bags used to wash delicate fabrics, etc., such that the child seat apparatus 10 may be completely washable in the bag 56.

In the expanded position, the collapsed child seat apparatus 10 is untwisted and unfolded so that the loop member 38 expands to spread out to the substantially circular child seat apparatus 10 such that the seat portion 18 extends down below the tray portion 20. In the expanded position, the loop member 38 keeps the tray portion 20 taut.

Figure 2:
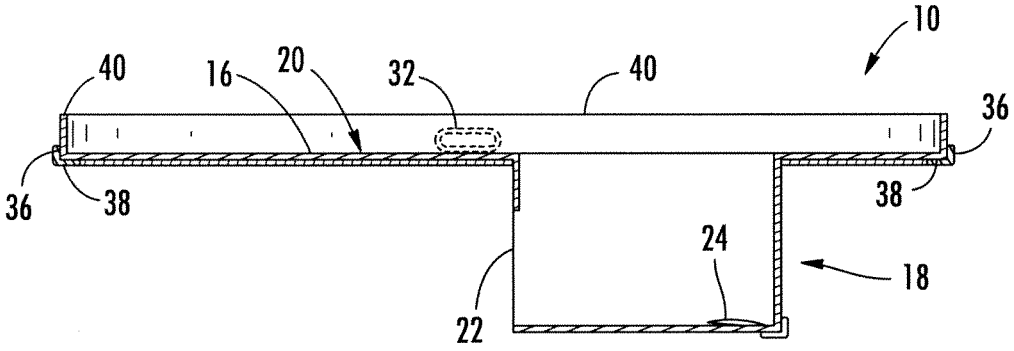
FIG. 2 is an elevational, partial cross-section view of a seat portion of the child seat apparatus of FIG. 1.

Referring now to the embodiment of FIGS. 1-3, in use, at a restaurant, the seat portion 18 of the child seat apparatus 10 is positioned in the seat of the high chair 12. The straps 26 of the high chair belt are passed though the apertures 24. A child is placed in the seat portion 18 of the child seat apparatus 10 and the straps 26 of the high chair belt are fastened around the child. Toys and food are given to the child. When the toys or food are dropped, the toys or food are contained on the tray portion 20 of the child seat apparatus 10, e.g., within the child reachable area of the tray portion 20, thus preventing the toys or food from falling to the floor of the restaurant and extending the play surface. The child seat apparatus 10 may be brought to the restaurant by a family or may be provided to the family by the restaurant. In addition, although an example of use of the child seat apparatus 10 is given in a restaurant, it should be understood that the child seat apparatus 10 may be used anyplace with a high chair so as long as the child seat apparatus 10 functions as described herein.

Figure 7:
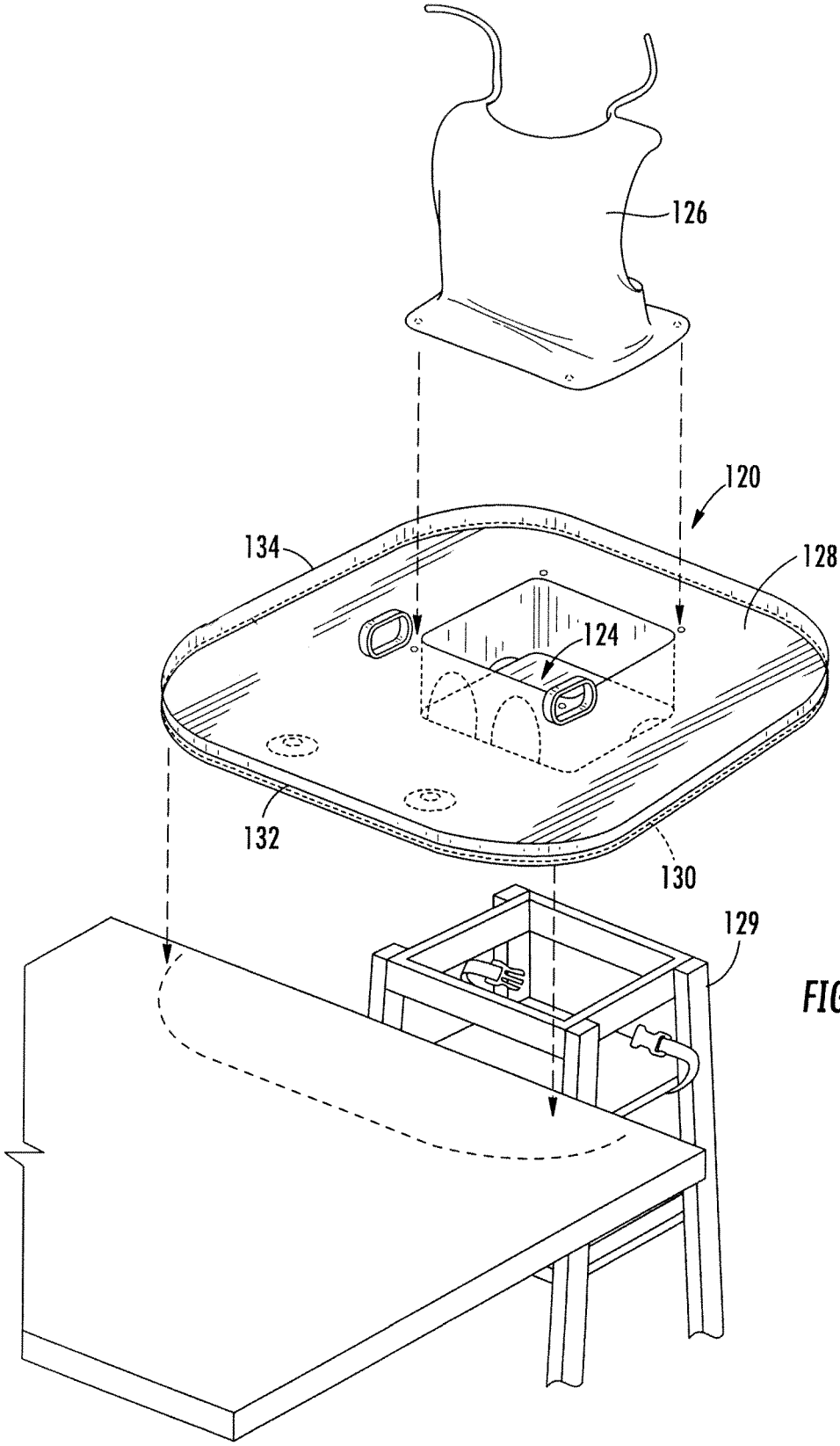
FIG. 7 is another embodiment of a child seat apparatus having a bib portion as constructed in accordance with the present invention.

Referring to FIG. 7, a child seat apparatus 120 is shown constructed in accordance with the present invention. The child seat apparatus 120 includes a seat portion 124, a bib portion 126, and a tray portion 128.

The seat portion 124 is similar to the seat portion 18, in that, the seat portion 124 is sized and dimensioned to fit a seat of a high chair 129, or other suitable seat types. The seat portion 124 may be formed of a selectively expandable material adapted to receive the lower body portion or torso of a child. The seat portion 124 is provided with apertures for allowing legs of a child to be positioned there-through. The apertures are positioned in the seat portion 124 and oriented with the leg opening(s) of the high chair, as necessary, to receive the legs of the child. The seat portion 124 is also provided with apertures for passage of straps that form a high chair belt. Passage of the straps through the apertures allows the straps to be positioned around the child's lower body or alternatively, any other portion of the child's body, and fastened, if desired. Belt fasteners are generally known in the art and may include clips, snaps, hook and loop, buckles, and the like, so that the child is secured in the seat portion 124 of the child seat apparatus 120 and to the high chair.

The bib portion 126 is similar to a bib portion 72 (FIGS. 8 and 9), in that the bib portion 126 has a first end, a second end and a body extending between the first end and the second end of the bib portion 126 for covering a portion of the upper torso of an individual. It should be understood by one of ordinary skill in the art that the body of the bib portion 126 may be configured in a variety of shapes to cover portions of the body of an individual. The second end of the bib portion 126 may be removably attachable to a portion of the seat portion 124, or the tray portion 128. Further, the second end of the bib portion 126 may be directly attached to a portion of the seat portion 124, or the tray portion 128 or may simply be configured to lay or wrap about a portion of the tray portion 128. Fasteners are provided on the first end of the bib portion 126 for extending about the neck or torso of the individual and connecting the bib portion 126 of the child seat apparatus 120 to the individual. It should be understood that any fastener, such as ties, clips, snaps, hook and loop, buckles, or any means of fastening one object to another may be utilized for connecting the bib portion to the individual. Further, it should be understood that the bib portion 126 may be configured to surround portions of a chair or some other object in which an individual utilizing the child seat apparatus 120 is positioned. Suitable materials for construction of the bib portion 126 include flexible, semi-flexible, washable, water-resistant, or disposable materials. However, it should be understood by one of ordinary skill in the art that any such material for constructing bibs or aprons may be utilized so long as the bib portion 126 functions in accordance with the present invention as described herein.

The tray portion 128 is similar to the tray portion 20 and/or a tray portion 74 (FIGS. 8 and 9) in use, function, and structure, so long as the child seat apparatus 120 functions in accordance with the present invention as described herein. The tray portion 128 includes a loop member 130 similar to the loop member 38 and/or the loop member 100 in use, function, and structure, so long as the child seat apparatus 120 functions in accordance with the present invention as described herein. The loop member 100 may be covered with a piece of material to attach it to a portion of the child seat apparatus 120, or disposed in a protective channel integrated with a rim 132 extending circumferentially around the tray portion 128, so as to enable the folding features of the child seat apparatus 120. The protective channel may also prevent contact by a child or other individual with the loop member 100. The loop member 100 may also be removable from the child seat apparatus 120. In an alternative embodiment, the loop member 100 is rigid so that the child seat apparatus 120 tends to retain a single shape. It should be understood that the shape of the collapsible child seat apparatus 120 may vary depending on the shape of the tray portion 128 of the child seat apparatus 120.

In another embodiment, a border 134 extends in a generally vertical direction a distance from the rim 132 so as to contain food, toys, pacifiers, or other objects that are thrown, dropped or might otherwise be dropped on the floor. The ability to contain food provides benefit to the public health by preventing excessive food scrap under high chars, which when quickly cleaned by staff, often leaves residue and crumbs which attract insects and vermin. The border 134 may be constructed out of the same or different material than that used to construct the tray portion 128. The border 134 may be permanently or removably connected to the tray portion 128.

Figure 8:
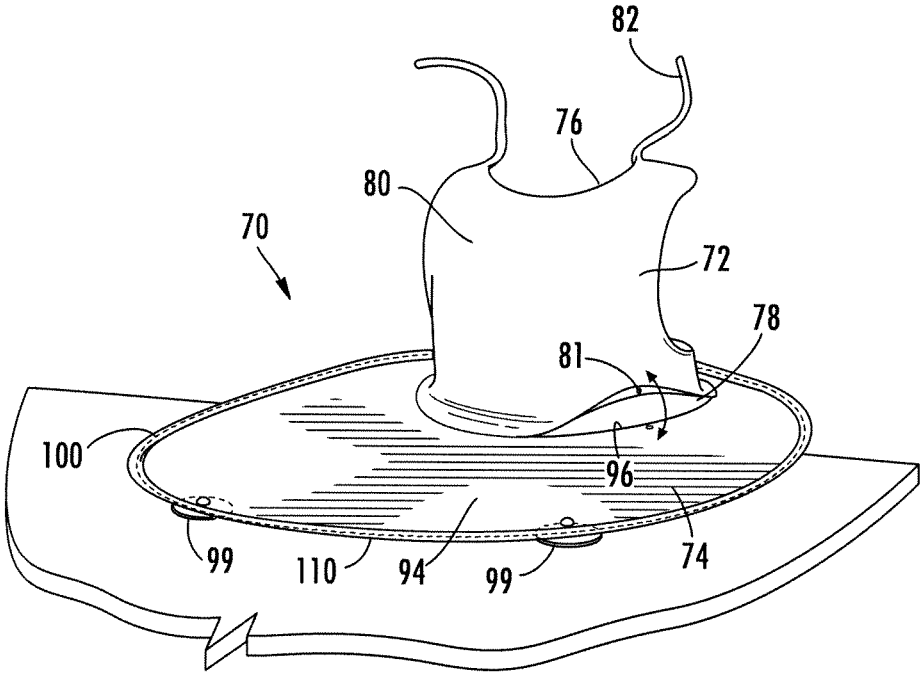
FIG. 8 is a front view of one embodiment of a tray apparatus constructed in accordance with the present invention.
Figure 9:
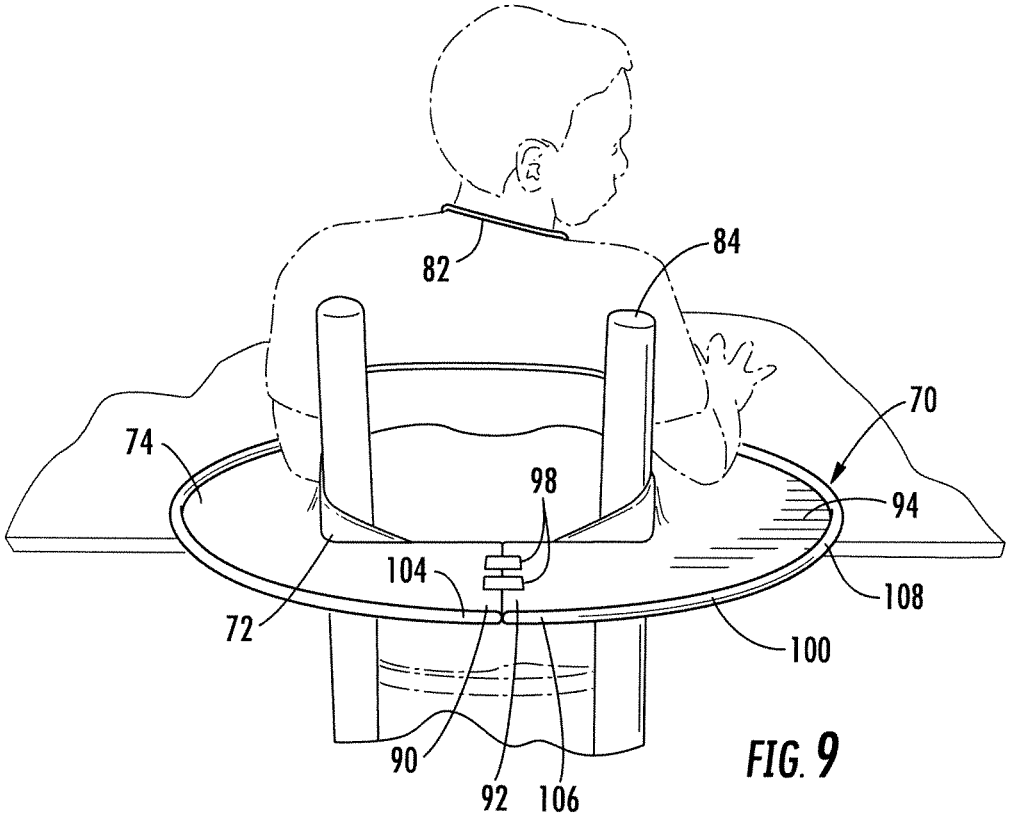
FIG. 9 is rear view of the tray apparatus of FIG. 8.

Referring to FIGS. 8 and 9, an embodiment is shown of a tray apparatus 70. Suitable materials for construction include woven, non-woven fabric, flexible, semi-flexible, plastic film materials such as vinyl, plastics, polymeric materials, and composite materials. The material may be water-resistant, washable, or waterproof. In addition, the tray apparatus 70 may be constructed from any disposable material, such as a disposable waxed or coated flexible paper or thin plastic, or any reusable material. The tray apparatus 70 may also be constructed in any of a variety of colors and patterns. The tray apparatus 70 material may also be formed of a mesh or net-like material, designed to catch solid objects but allow fluids to pass. Further, it will be appreciated that the tray apparatus 70 can be sized and shaped from any suitable material and dimension so long as the tray apparatus 70 functions as described herein. The tray apparatus 70 may be used for a child and also be utilized for any individual requiring assistance in living, such as a senior adult or an individual having health issues or disabilities, so long as the tray apparatus 70 functions in accordance with the present invention as described herein.

The tray apparatus 70 has a bib portion 72 and a tray portion 74. The bib portion 72 has a first end 76, a second end 78 and a body 80 extending between the first end 76 and the second end 78 of the bib portion 72 for covering a portion of the upper torso of an individual. It should be understood by one of ordinary skill in the art that the body 80 of the bib portion 72 may be configured in a variety of shapes to cover portions of the body of an individual. The second end 78 of the bib portion 72 may be removably or permanently attachable to a portion of the tray portion 74. Connectors 81 may be utilized to removably attach the bib portion 72 to the tray portion 74. Connectors such as snaps, ties, clips, hook and loop, buckles, or any other means of fastening one object to another known to one of ordinary skill in the art. Further, the second end 78 of the bib portion 72 may be directly attached to a portion of the tray portion 74 or may simply be configured to lay or wrap about a portion of the tray portion 74. Fasteners 82 are provided on the first end 76 of the bib portion 72 for extending about the neck or torso of the individual and connecting the bib portion 72 of the tray apparatus 70 to the individual. It should be understood that any fastener, such as ties, clips, snaps, hook and loop, buckles, or any means of fastening one object to another may be utilized for connecting the bib portion to the individual. Further, it should be understood that the bib portion 72 may be configured to surround portions of a chair 84 or some other object in which an individual utilizing the tray apparatus 70 is positioned. Suitable materials for construction of the bib portion 72 include flexible, semi-flexible, washable, water-resistant, or disposable materials. However, it should be understood by one of ordinary skill in the art that any such material for constructing bibs or aprons may be utilized so long as the bib portion 72 functions in accordance with the present invention as described herein.

The tray portion 74 has a first end 90, a second end 92, and a surface portion 94 extending therebetween. The surface portion 94 is movable so that the first end 90 and the second end 92 of the tray portion 74 are movable and attachable to form an opening 96. The first end 90 and the second end 92 are removably connected with a connecting member 98. The connecting member 98 may be any such connector for connecting one object to another such as, ties, clips, snaps, hook and loop, buckles, or any means of fastening one object to another.

In one embodiment, the surface portion 94 is formed into a substantially continuous shape by connecting the first end 90 to the second end 92 to form an opening 96. The tray portion 74 is shown as substantially continuous in shape to form a saucer for catching food, fluid or some other substance. Iit should be understood that the tray portion 74 may be any shape, such as circular, oval, square, rectangular, triangular, polygonal, quadrilateral, ellipsoidal and the like, for example. The opening 96 is capable of being formed, configured, sized, and dimensioned to receive an individual. In another embodiment, the opening 96 is formed in the material which forms the tray portion 74. The tray portion 74 substantially surrounds the bib portion 72 of the tray apparatus 70. It should be understood that the tray portion 74 may partially or completely surround the bib portion 72. In alternative embodiments, however, the tray portion 74 surrounds only a portion of the bib portion 72. The tray portion 74 may be permanently or removably connected to the bib portion 72. The surface of the tray portion 74 prevents contact by an individual with a table surface or some other area, thus acting as a sanitary barrier. The tray portion 74 may be sanitized with cleaning agents as desired. Optionally, it should be understood that the tray portion 20 may be used with the bib portion 72.

Under side restraint straps (not shown) are optionally attached on the underside of the tray portion 74 to secure the tray apparatus 70 to a table or other structure. At least one fastener 99, such as suction cups, or other means of fastening, such as adhesive, are optionally attached to the underside of the tray portion 74 for securing the tray portion 74 to a table or other structure.

The tray apparatus 70 includes a loop member 100 or support member attached to the tray portion 74 at a position near the outer perimeter of the tray portion 74. The loop member 100 is similar to the loop member 38 in use, function, and structure with the tray portion 20. Further, in this embodiment, the loop member 100 is provided with a break, if the loop member 100 is a preformed shape or a formable linear structure. The loop member 100 includes a first end 104 and a second end 106 and a body portion 108 extending between the first and second ends 104 and 106, respectively. The first and second ends 104 and 106, respectively, are connected when the first end 90 and the second end 92 of the tray portion 74 are connected. The first and second ends 104 and 106 may be coated with rubber or some protective material to prevent exposure. Further, the loop member 100 may be covered with a piece of material to attach it to the body 80, or disposed in a protective channel 110 extending substantially circumferentially around the tray portion 74, depending on the shape of the tray portion 74. The protective channel 110 may also prevent exposure of the loop member 100. Optionally, the tray apparatus 70 may include a rim or border which is similar to the rim 36 and border 40 in use, function and structure.

Referring now to FIGS. 8 and 9, in use, the surface portion 94 of the tray portion 74 is positioned about an individual and optionally about the object on which the individual is positioned. The first end 90 and the second end 92 of the tray portion 74 are connected by the connecting member 98. The body 80 of the bib portion 72 is positioned on the upper torso of the individual. The fasteners 82 are positioned about the neck of the individual and fastened which attaches the bib portion to the individual.

Figure 10:
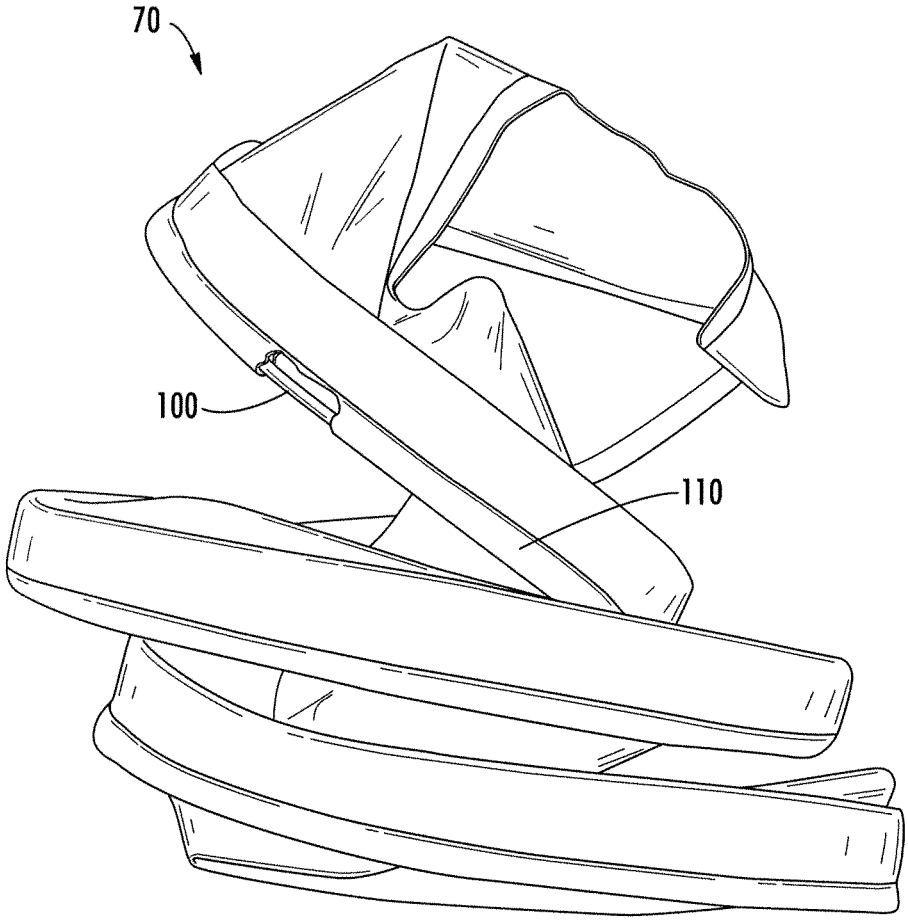
FIG. 10 is a pictorial representation of the tray apparatus of FIG. 8 movable in an alternative collapsible position.

Referring now to FIG. 10, the tray apparatus 70 is shown in a substantially collapsible position. In the collapsible position, the loop member 100 of the tray apparatus 70 may be moved to collapse the loop member 38 into a form smaller than the tray apparatus 70. It should be understood by one of ordinary skill in the art that the loop member 100 may be moved to collapse the tray apparatus into various smaller shapes depending on the shape of the tray apparatus 70 as described herein. Optionally, the tray apparatus, in the collapsed or open form, may be carried in a bag, or other such portable carrying device. The bag may be constructed from the same material as the tray apparatus 70. Alternatively, the bag may be constructed from a mesh-like material such as, for example, the mesh bags used to wash delicate fabrics, etc., such that the tray apparatus 70 may be completely washable in the bag. Further, the bag may be constructed from a disposable material so as to be disposed of after use.

In an open position, the loop member 100 of the collapsed tray apparatus 70 is movable so that the loop member 100 expands to open up into the tray apparatus 70. The collapsed tray apparatus 70 may be opened into various shapes as described herein. In the open position, the loop member 100 keeps the tray portion 74 of the tray apparatus 70 in a taut condition.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A tray apparatus, comprising:

a bib portion sized and dimensioned to be positioned about an individual, the bib portion having an opening for receiving the individual's upper limbs and allowing use of the upper limbs; and a tray portion substantially surrounding the bib portion and adapted to surround the torso of the individual, the tray portion having a first end, a second end and a surface portion extending between the first and second ends such that the first end is attached to the second end to form an opening sized and dimensioned for receiving the individual, wherein the surface portion of the tray portion surrounds at least a portion of the opening and wherein the tray portion has a loop member attachable to the tray portion such that the loop member having a first end and a second end which are connected to hold the tray portion in a substantially taut condition to form a planar surface extending about the bib portion, the bib portion being removably attachable to the tray portion.

2. The tray apparatus of claim 1 wherein the bib portion is provided with a fastener for attaching the bib portion to the individual.

3. The tray apparatus of claim 1 wherein the loop member is attachable to the tray portion at a position substantially near the outer perimeter of the tray portion.

4. The tray apparatus of claim 1 wherein the loop member is movable between an extended position and a collapsed position, in the extended position, the loop member holds the tray portion in a substantially flat condition so that the tray portion is substantially taut to form the substantially planar surface, in the collapsed position, the loop member is movable to collapse the tray apparatus into a smaller form.

5. The tray apparatus of claim 1 wherein the loop member is formed of a flexible, semi-rigid, resilient, foldable, malleable or impressionable material.

6. The tray apparatus of claim 1 further comprising a connecting member for connecting the first end of the tray portion to the second end of the tray portion.

7. The tray apparatus of claim 1 further including a border wherein the border is connected to the tray portion for preventing an object or substance from falling off the surface of the tray portion.

8. The tray apparatus of claim 1 wherein the tray portion is formed of a reusable or disposable material.

9. The tray apparatus of claim 1 wherein the tray portion is provided with a fastener for selectively attaching the tray portion to a surface.

* * * * *